United States Patent [19]

Nakano

[11] Patent Number: 4,875,333

[45] Date of Patent: Oct. 24, 1989

[54] PLASTIC TRAVELLER FOR RING SPINNING MACHINERY

[75] Inventor: Yuzuru Nakano, Takarazuka, Japan

[73] Assignee: Kanai Juyo Hyogo, Kogyo Company Limited, Hyogo, Japan

[21] Appl. No.: 263,248

[22] Filed: Oct. 27, 1988

[30] Foreign Application Priority Data

Nov. 6, 1987 [JP] Japan ..... 62-281396

[51] Int. Cl.[4] ..... D01H 7/60

[52] U.S. Cl. ..... 57/125

[58] Field of Search ..... 57/119, 120, 125, 126

[56] References Cited

U.S. PATENT DOCUMENTS

| | | | |
|---|---|---|---|
| 3,134,219 | 5/1964 | Carter et al. | 57/125 |
| 3,396,527 | 8/1968 | Joseph, Jr. et al. | 57/125 |
| 4,079,579 | 3/1978 | Cory | 57/125 |

FOREIGN PATENT DOCUMENTS

| | | | |
|---|---|---|---|
| 62-97925 | 5/1987 | Japan | 57/125 |

*Primary Examiner*—John Petrakes

*Attorney, Agent, or Firm*—Wenderoth, Lind & Ponack

[57] ABSTRACT

A nylon traveller for spinning machinery according to the present invention is composed in the desired shape, using polyamide resin (nylon 4–6) of crystalline structure which has spherulites of substantially uniform size of 0.5–4 μm densely associated with each other and which has a degree of crystallinity of 35–55%.

5 Claims, 2 Drawing Sheets

PLASTIC TRAVELLER FOR RING SPINNING MACHINERY

BACKGROUND OF THE INVENTION

1. Field of the Invention

This invention relates to a nylon traveller for spinning machinery, including a ring spinning machine, a ring twisting machine, etc.

2. Description of the Prior Art

The recent tendency in spinning machinery is that the spindle speed has been increased more and more for raising the productivity of the spinning machinery. Also, there is an increased tendency to spin or twist yarn of high tension out of carbon fiber, ceramic fiber, etc. However, this tendency has caused trouble in that the temperature of a running traveller at the part where it makes contact with yarn and a ring rises higher than usual due to a large load between the traveller and yarn/ring and resultant frictional heat generated by the increase of frictional force.

In the case of nylon travellers made of nylon 6—6 which are generally used for ring spinning machines and ring twisting machines, these travellers do not have high heat-resistance (thermal deformation temperature under a constant load of 4.6 kg/cm$^2$ is 235° C. but under a constant large load it is 90° C.) and therefore in the recent ring spinning and ring twisting operations where a large load is applied to running travellers, abrasion of travellers progresses rapidly, with the result of "yarn breakage", "yarn fluffing", "severing of traveller at yarn passing portion", etc. Thus, improvement of productivity and improvement of yarn quality are hindered. Since the conventional nylon traveller made of nylon 6—6 has crystalline grains of large diameter (10–20 μm), namely, it is of coarse crystalline structure, it is not satisfactory in heat-resistance and abrasion-resistance.

SUMMARY OF THE INVENTION

The present invention has been made to solve the above problems.

An object of the present invention is to provide nylon travellers for spinning machinery which are improved in heat-resistance and abrasion-resistance to such an extent that these travellers well withstand the operation under a severe high load. More particularly, the nylon traveller according to the present invention is one in which its head portion, yarn passing portion, trunk portion and leg portion are made entirely of nylon or made mostly of nylon and partly inserted with metal, and each portion other than metal is composed of polyamide resin of a crystalline structure with densely associated spherulites of substantially uniform size of 0.5–4 μm, preferably 1–2 μm and a degree of crystallinity of 35–55%, preferably 43–50% (DSC Method).

The above polyamide resin is nylon 4-6 of molecular structural formula

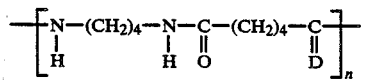

which shows, under a constant load of 18.6 kg/cm$^2$, a thermal deformation temperature of 200° C.–220° C. in non-reinforced grade and up to 285° C. in reinforced grade (reinforcing filler is mixed).

The nylon traveller for spinning machinery according to the present invention is composed of a composite material, i.e., nylon 4-6 mixed with 10–35% inorganic or organic fiber as reinforcing fillers and has improved heat-resistance and abrasion-resistance. As to the inorganic or organic fiber, such fibers are ceramics fiber, whisker, carbon fiber, metal fiber, aramid fiber, etc. are suitable.

Also, the nylon traveller according to the present invention is improved still further in heat-resistance and abrasion-resistance, if it is composed of nylon 4-6 mixed with a composite material in which 5–20% inorganic powder or grains (for example, glassy carbon, diamond, graphite, ceramic grains, metal powder, etc.) are mixed. Furthermore, the nylon traveller according to the present invention is improved in lubricity, if the above-mentioned composite material is mixed additionally with 1–2% solid lubricant (for example, tetrafluoroethylene, molybdenum disulphide, etc.).

Nylon 4-6 which is used for the ring traveller according to the present invention has basic physical properties of a fusing point (DSC Method) of 290° C.–295° C., glass transition temperature of 78° C.–80° C., density of 1.18 g/cm$^3$ and speed of crystallinity of 4–8$^1$/sec which are better than those of nylon 6—6 (of fusing point of 262°–264° C., glass transition temperature of 66° C.–70° C., density of 1.14 g/cm$^3$ and speed of crystallinity of 1.64$^1$/sec).

With the above characteristics of nylon 4-6 in view, the inventor has completed a nylon traveller which possesses heat-resistance, abrasion-resistance and lubricity well adapted to use under a high load.

BRIEF DESCRIPTION OF THE DRAWINGS

The nature and advantage of the present invention will be understood more clearly from the following description made with reference to the accompanying drawings, in which.

DETAILED DESCRIPTION OF THE INVENTION

A description is made below of embodiments of the present invention with reference to the accompanying drawings.

Embodiment 1

Figure 1:
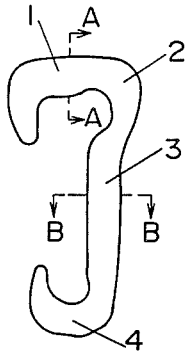
FIG. 1 is a front view of a nylon traveller for spinning machinery, showing an embodiment of the present invention.
Figure 2:
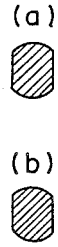
FIGS. 2(*a*) and (*b*) are cross sections, taken along the lines A—A and B—B respectively in FIG. 1.

A nylon traveller was formed of polyamide resin of thermal deformation temperature 200° C.–220° C. under a constant load of 18.6 kg/cm$^2$ (by D-648 Testing Method), for example, nylon 4-6 by using an injection molding machine, and was subjected to a heat treatment. It consists of a head portion 1, a yarn passing portion 2, a trunk portion 3 and a leg portion 4, as shown in FIG. 1 and FIG. 2 as an example. It is a vertical type nylon traveller and cross sectional shapes of its head portion and trunk portion are as shown in FIGS. 2(*a*) and (*b*) respectively. It is of crystalline structure with densely associated globular crystals of 1–2 μm.

A spinning test was carried out under the following conditions with a nylon traveller A according to the present invention and a conventional nylon 6—6 traveller B.

Spinning conditions:

| | |
|---|---|
| Fiber: | Ester filament for tire cord 1000 d/1 |
| Ring: | STJN Ø115 (vertical type sintered lubricated ring of 115Ø mm in diameter and 12.7 mm in height) |
| Weight of traveller: | 220 mg |
| Spindle speed: | 6,800 r.p.m. |
| Time the traveller was used: | 2 months × 24 hr. (total length spun: 16,440 m/dof × 63 dof = 1,035,720 m) |

Figure 3:
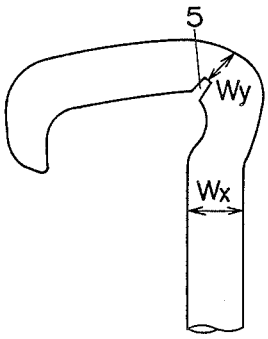
FIG. 3 is a main part of the traveller for spinning machinery according to the present invention.

After 2 months' spinning test, the traveller A according to the present invention and the conventional traveller B were detached from the ring and the width Wx of the part which makes contact with a ring and the width Wy at the yarn passing part, as shown in FIG. 3, were measured.

Figure 4:
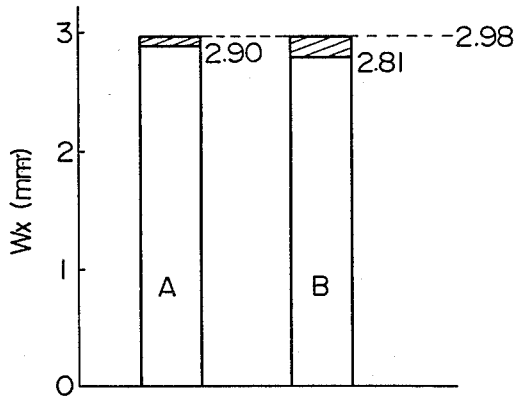
FIG. 4 shows a comparative abrasion of the width (Wx) at the part of the traveller which makes contact with a ring, between the traveller A according to the present invention and the conventional traveller B.

FIG. 4 is a comparative figure of the width Wx at the part which makes contact with a ring, between the traveller A according to the present invention and the conventional traveller B. As can be seen from FIG. 4, the original width of 2.98 mm at the part which makes contact with the ring before testing was reduced to 2.90 mm in the case of the traveller A but was reduced to 2.81 mm in the case of the conventional traveller B, namely, the amount of abrasion at that part was 0.08 mm in the case of the traveller A but was 0.17 mm in the case of the conventional traveller B. This indicates that the traveller A according to the present invention abrades about half as much as the conventional traveller B.

Figure 5:
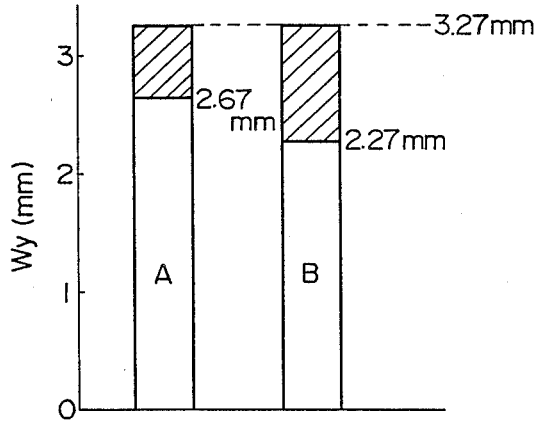
FIG. 5 shows a comparative abrasion of the width (Wy) at the yarn passing portion of the traveller, between the traveller A according to the present invention and the conventional traveller B.

FIG. 5 is a comparative figure of abrasion of the width Wy at the yarn passing portion, between the traveller A according to the present invention and the conventional traveller B. As shown in FIG. 3, abrasion traces 5 of groove-shape are formed at the yarn passing portion due to friction caused by yarn passing. The original width (3.27 mm) at the yarn passing portion before the spinnning test was reduced to Wy=2.67 mm in the case of the traveller A according to the present invention but was reduced to Wy=2.27 mm in the case of the conventional traveller B, namely, the amount of abrasion at the yarn passing portion was 0.6 mm in the case of the traveller A according to the present invention, as compared with 1.0 mm in the case of the conventional traveller B. Thus, it has been found that as compared with the conventional traveller, the traveller according to the present invention displays high heat-resistance and abrasion-resistance against friction between the ring and yarn, has a service life about 1½ times as long as the conventional traveller, and involves less yarn fluffing due to less abrasion at its yarn passing portion.

Embodiment 2

A nylon traveller for spinning machinery was formed of a composite material comprising nylon 4-6 used in Embodiment 1 mixed with about 10–35% (20%, for example) glass fiber by using an injection molding machine, and was subjected to a heat treatment. This nylon traveller had such crystal structure that spherulites of 1–2 μm were densely associated with each other. This nylon traveller showed a thermal deformation temperature of 285° C. under a constant load of 18.6 kg/cm$^2$ (by ASTM D-648 Testing Method).

A spinning test was carried out under the following conditions with the nylon traveller C (of Embodiment 2) according to the present invention and the conventional nylon traveller D (nylon 6—6 mixed with 20% glass fiber).

Spinning conditions:

| | |
|---|---|
| Fiber: | Glass fiber ECG 150 ⅓ |
| Ring: | Vertical type sintered ring of 140Ø mm in diameter and 16.8 mm in height. |
| Spindle speed: | 6,000 r.p.m. |

The result of the above test indicated that the exchange cycle of the traveller C according to the present invention was 60–80 days, as compared with 30–50 days in the case of the conventional traveller D, namely, the service life of the traveller C according to the present invention is about twice as long as that of the conventional traveller D.

Embodiment 3

A nylon traveller for spinning machinery was formed of a composite material comprising nylon 4-6 used in Embodiment 1 mixed with 30% glass fiber and 5% molybdenum disulphide by using an injection molding machine, and was subjected to a heat treatment. This nylon traveller had such crystal structure that spherulites of 1–2 μm were densely associated with each other. This nylon traveller showed a thermal deformation temperature of 285° C. under a constant load of 18.6 kg/cm$^2$ (by ASTM D-648 Testing Method).

A spinning test under the same conditions as Embodiment 1 was carried out with the above nylon traveller E and the conventional nylon traveller F (nylon 6—6 mixed with 30% glass fiber and 5% molybdenum disulphide). The result of the test indicated that the service life of the traveller E according to the present invention was about 2.5 times as long as that of the conventional traveller F.

Embodiment 4

A nylon traveller for spinning machinery was made of a composite material comprising nylon 4-6 used in Embodiment 1 mixed with 10% SiC and 3% tetrafluoroethylene in the same way as in the above embodiment. This nylon traveller presented a crystalline structure with densely associated spherulites of 1–2 μm.

A spinning test under the same testing conditions as Embodiment 2 was carried out with the above nylon traveller G according to the present invention and the conventional traveller H comprising nylon 6—6 mixed with fillers mentioned above. The result of the test indicated that the service life of the traveller G according to the present invention is about twice as long as that of the conventional traveller H.

The shape of the nylon traveller according to the present invention is not limited to that in the above embodiments but is variable according to the count of yarn. Also, the present invention is applicable to such travellers with metal inserted therein (for example, inside of the yarn passing portion).

Since the nylon traveller according to the present invention is constructed as mentioned above, it has improved abrasion-resistance and improved heat-resistance and can spin and twist yarn under a large load. It involves less streak abrasion at its yarn passing portion and is almost free from severing at that portion. Thus, the nylon traveller according to the present invention contributes to the improvement of yarn quality, stable operation for a long time, improvement of productivity, etc.

What is claimed is:

1. A resin traveller for spinning machinery made mainly of nylon 4-6, having a crystalline structure of 0.5–4 μm in the size of spherulites and 35–55% (DSC method) in the degree of crystallinity, and having a thermal deformation temperature of 200°–285° C. under a load of 18.6 kg/cm$^2$.

2. A resin traveller for spinning machinery as defined in claim 1, wherein the nylon 4-6 is mixed with 10–35% reinforcing fillers of inorganic or organic fibers.

3. A resin traveller for spinning machinery as defined in claim 2, wherein 1–2% solid lubricant is added to the mixture.

4. A resin traveller for spinning machinery as defined in claim 1, wherein nylon 4-6 is mixed with 5–20% reinforcing fillers of inorganic powder or particles.

5. A resin traveller for spinning machinery as defined in claim 4, wherein 1–2% solid lubricant is added to the mixture.

* * * * *

UNITED STATES PATENT AND TRADEMARK OFFICE

CERTIFICATE OF CORRECTION

PATENT NO. : 4,875,333

DATED : October 24, 1989

INVENTOR(S) : Yuzuru NAKANO

It is certified that error appears in the above-identified patent and that said Letters Patent is hereby corrected as shown below:

Column 2, line 8, change "are" to --as--.

Signed and Sealed this

Fifteenth Day of January, 1991

*Attest:*

HARRY F. MANBECK, JR.

*Attesting Officer*

*Commissioner of Patents and Trademarks*